US008066262B1

(12) United States Patent
Dzula, III et al.

(10) Patent No.: US 8,066,262 B1
(45) Date of Patent: Nov. 29, 2011

(54) POWERED CANISTER OPENER

(75) Inventors: Walter Dzula, III, Fredericksburg, VA (US); Kevin Matthew Cogley, King George, VA (US); Laura Marie Haak, Park Ridge, IL (US); Gregory Neumann Miller, Spotsylvania, VA (US); Brian Franklin Rainer, King George, VA (US); Anthony Charlie Richardson, King George, VA (US); George Russell Richardson, Norfolk, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 426 days.

(21) Appl. No.: 12/456,270

(22) Filed: May 28, 2009

(51) Int. Cl.
*B66D 1/30* (2006.01)

(52) U.S. Cl. ..... 254/371; 254/334

(58) Field of Classification Search ..... 254/264, 254/279, 329, 334, 371, 372; 269/136
See application file for complete search history.

(56) References Cited

U.S. PATENT DOCUMENTS

| | | | | |
|---|---|---|---|---|
| 4,768,693 | A | 9/1988 | Tomaszewski | 225/94 |
| 5,228,203 | A | 7/1993 | Hahn | 30/417 |
| 5,313,708 | A | 5/1994 | Edwards et al. | 30/417 |
| 6,158,130 | A | 12/2000 | Chong | 30/418 |
| 6,886,260 | B1 | 5/2005 | Lee | 30/421 |

*Primary Examiner* — David B Thomas
(74) *Attorney, Agent, or Firm* — Gerhard W. Thielman, Esq.

(57) ABSTRACT

A device for opening a cylindrically bilateral filter canister, such as that houses the M98 chemical, biological, radiological filter for storage and transport. The filter canister is sealed with an epoxy-covered pull-cord that ends in an eye-loop. The device is disposed on a platform for the opening operation. The device includes a frame, first and second rollers, and a winch. The frame includes first and second support members. The first support member engages the platform and supports the second support member. The first and second rollers are disposed parallel to the platform to support the canister along its periphery. The winch includes a drum and a motor and is disposed on the frame. The drum engages the eye-loop. The motor turns said drum to receive the pull-cord from the canister.

6 Claims, 3 Drawing Sheets

POWERED CANISTER OPENER

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to a device to open filter canisters. In particular, the device is particularly related to a motorized mechanism to reduce risks and fatigue associated with manual labor effort for such opening operations.

Collective protection (COLPRO) systems are employed in military environments, such as naval ships to remove contaminants from air. The military standard filter set employs M98 chemical, biological, radiological (CBR) filters for this purpose. For warehousing and transport, each filter is packed into a ruggedized cylindrical aluminum canister to protect against environmental and handling hazards.

The shipping weight of a single loaded canister is approximately 65 lbs. Each canister is tightly sealed with a thick strip of epoxy, into which a plastic coated wire as a pull-cord with eye-loops on either end is embedded. The two ends of the pull-cord wire protrude from the epoxy seal. To open the canister the pull cord wire must be torn out from the epoxy, thereby removing the epoxy seal.

SUMMARY

Conventional mechanisms to open a filter canister yield disadvantages addressed by various exemplary embodiments of the present invention. In particular, various exemplary embodiments provide a motorized mechanism to reduce the considerable manual labor required to open a cylindrically bilateral filter canister, such as that used to store an M98 chemical, biological, radiological (CBR) filter. This mechanism reduces labor effort by utilizing powered opening techniques.

In various exemplary embodiments, the device operates to open a cylindrically bilateral filter canister, such as that houses the M98 CBR filter. The filter canister is sealed with an epoxy-covered pull-cord that ends in an eye-loop. The device is disposed on a platform for the opening operation. The device includes a frame, first and second rollers, and a winch.

The frame includes first and second support members. The first support member engages the platform and supports the second support member. The first and second rollers are disposed parallel to the platform to support the canister along its periphery. The winch includes a drum and a motor and is disposed on the frame. The drum engages the eye-loop. The motor turns said drum to receive the pull-cord from the canister.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
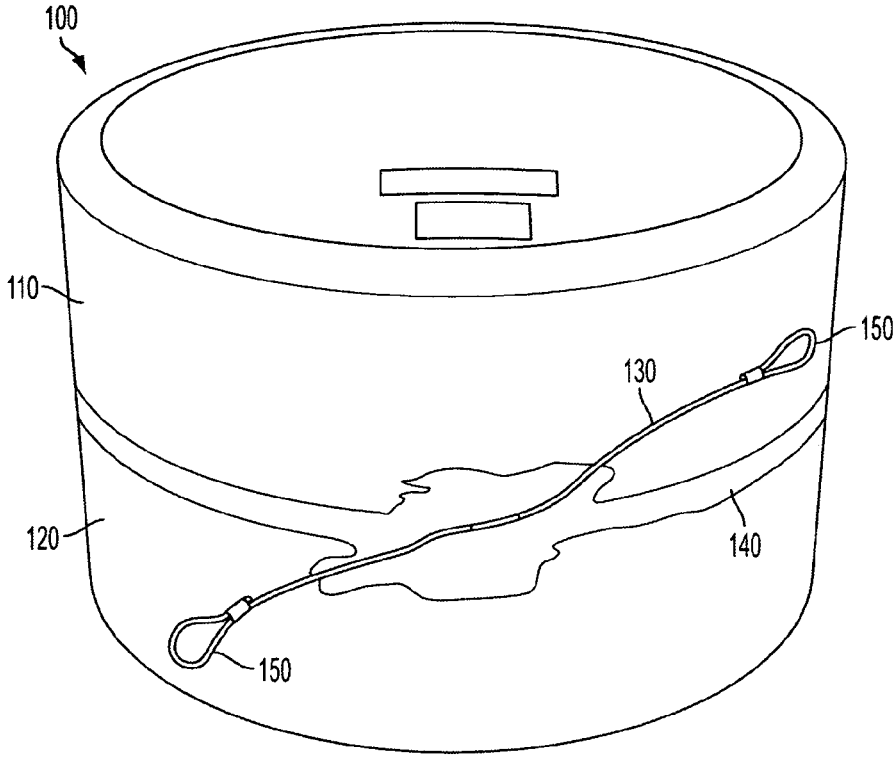
FIG. 1 is a perspective view of a canister.

FIG. 1 shows a perspective view of a cylindrical filter canister 100 for storage and shipment of an M98 chemical, biological, radiological (CBR) filter. The aluminum canister 100 measures approximately two-feet in diameter and extends approximately one-foot in thickness.

As shown in prone position, the canister 100 separates bilaterally into a top portion 110 and an identical bottom portion 120, secured together at the joining rim by a wire 130 and sealed with epoxy 140. The wire 130 includes a pair of loop ends 150. To open the canister 100 to retrieve the CBR filter, at least one of the loops 150 is pulled away from the canister 100 to tear the epoxy seal 140 and separate the portions 110, 120.

The canister can be opened using a pry-bar and hammer. This manual method utilizes no specialized tools or training. This process is extremely labor-intensive, and presents potential for personal injury and/or equipment damage. An alternative technique uses a manual opener currently used aboard naval vessels.

Figure 2:
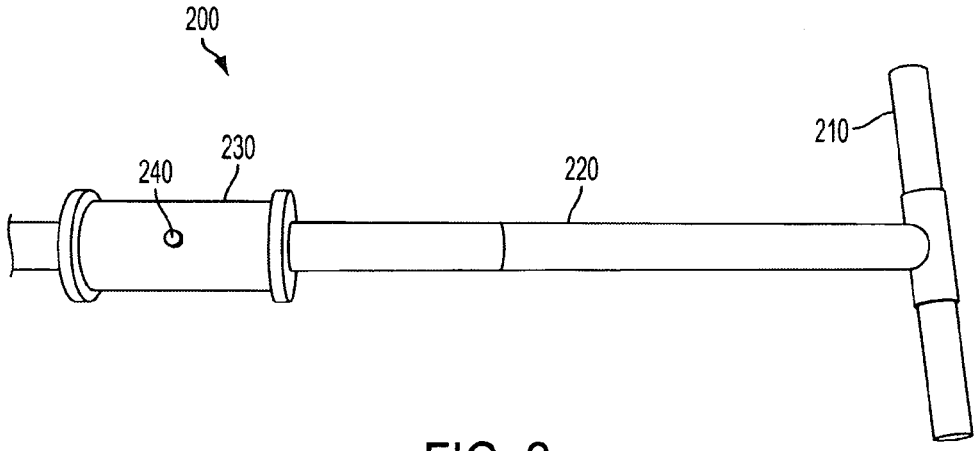
FIG. 2 RELATED ART
FIG. 2 is a perspective view of a conventional manual tool.

FIG. 2 shows a perspective view of this conventional manual opener tool 200 currently employed to open the canister 100. The tool 200 includes a handle 210 attached to a shaft 220. A cylindrical drum 230 with a radially protruding button 240 attaches to the shaft 220 opposite the handle 210. The button 240 engages one of the loops 150 to wind around the drum 230 as the handle 210 turns around the perimeter of the canister 100, thereby pulling the wire 130 from the epoxy seal 140.

Although providing a less labor-intensive means of opening the CBR filter canister than by the pry-bar, the opening process (especially over the course of many canisters) causes significant manual fatigue. This opener tool 200 is currently the preferred method for opening CBR filter canisters in both Navy shipboard and shore-based activities.

Figure 3:
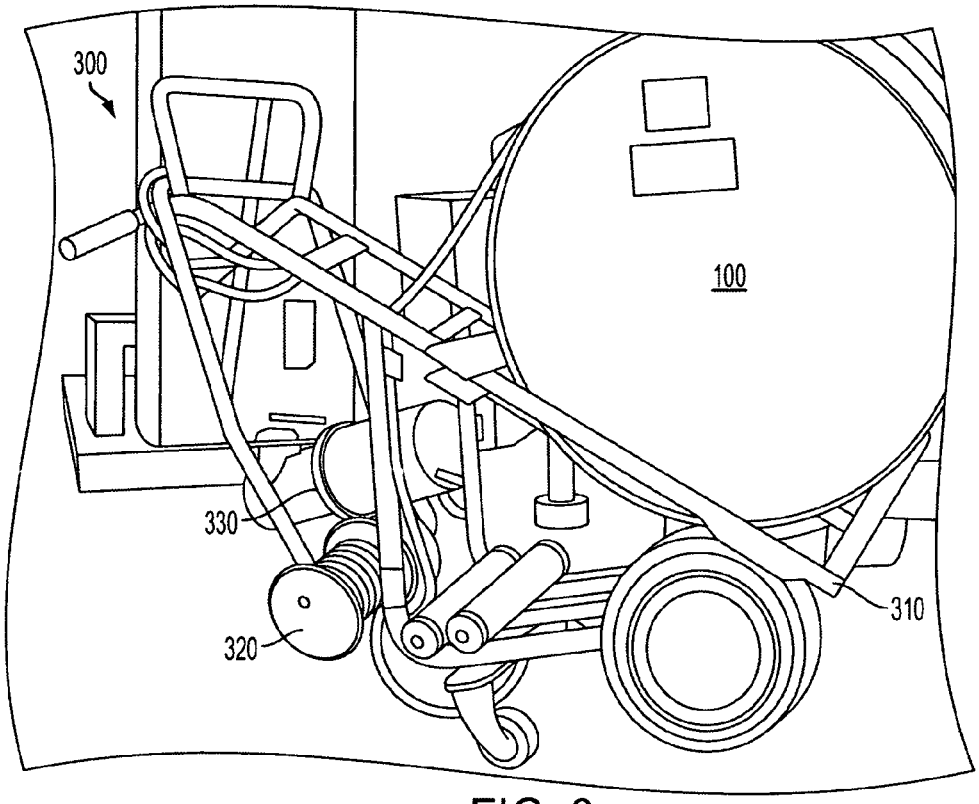
FIG. 3 is a perspective view of a dolly-mount tool.

FIG. 3 shows a perspective view of hand-truck powered opener 300. A rollable hand-truck dolly 310 holds the canister 100. An electric winch that includes a drum 320 with its associated motor 330 attach to the dolly 310 below the truck handle. One of the loops 150 is wound a nylon rope and fed into the winch 320, which the motor 330 turns to unwind the wire 130. However, the size, weight and operational constraints (requiring two persons to lift the canister and engage the motor) render this configuration impractical for cramped ship-board conditions.

Figure 4:
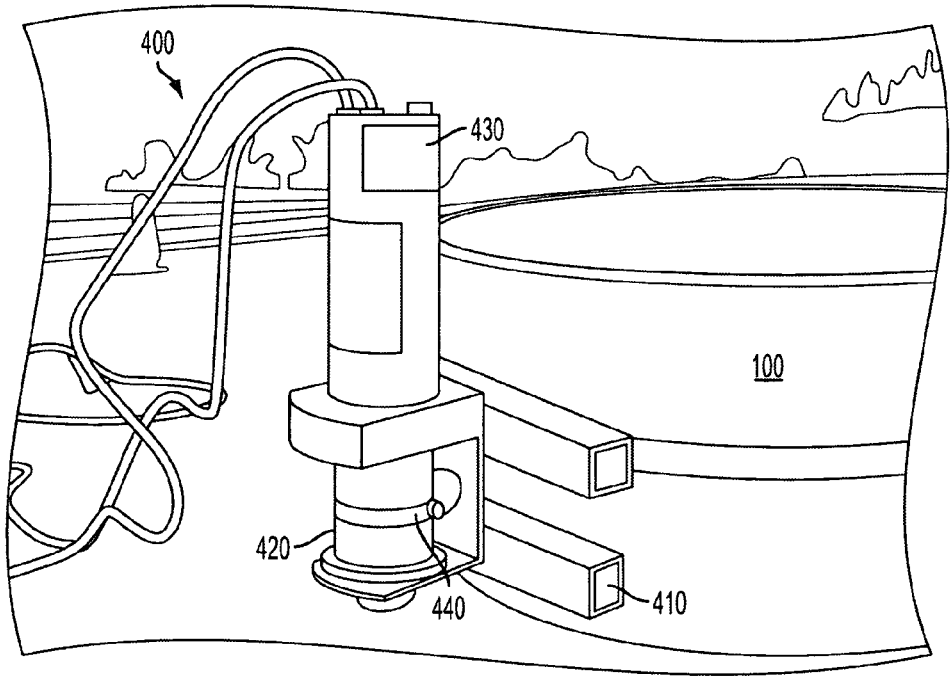
FIG. 4 is a perspective view of a roll-around tool.

FIG. 4 shows a perspective view of a compact roll-around opener 400 also developed at NSWCDD. A pair of tubes 410, with square-cross-section and rollers, is disposed adjacent to the canister 100 along the radial periphery. An electric-driven winch, including a cylindrical drum 420 coaxially connected to a motor 430, attaches to the tubes 410. A radially-protruding button 440 extends from drum 420 to engage one of the loops 150 as the motor 430 turns the drum 420 to pull the wire 130 from the epoxy seal 140.

The opener 400 operates using the small electric winch that is mounted upon compact rollers. Opening of a CBR filter canister is accomplished by positioning the drum 420 along the side of the canister 100 and drawing the canister-sealing wire 130 onto the winch drum by snagging the loop 150 around the button 440. As the wire 130 is drawn from the epoxy seal 140, the opener 400 is free to roll around the circumference of the canister 100.

Advantages to this configuration include compact size and reduced operator strain, as no lifting of the canister 100 is required. However, drawbacks include absence of supporting structure for the opener 400, where upon completing the unwrap operation, the opener 300 falls onto the floor near the canister 100. Due to the relatively small clearance around drum, this can cause frequent work stoppages to clear the area of wire and epoxy debris. Additionally, the small diameter of the drum 420 produces clogging from epoxy accumulation.

Figure 5A:
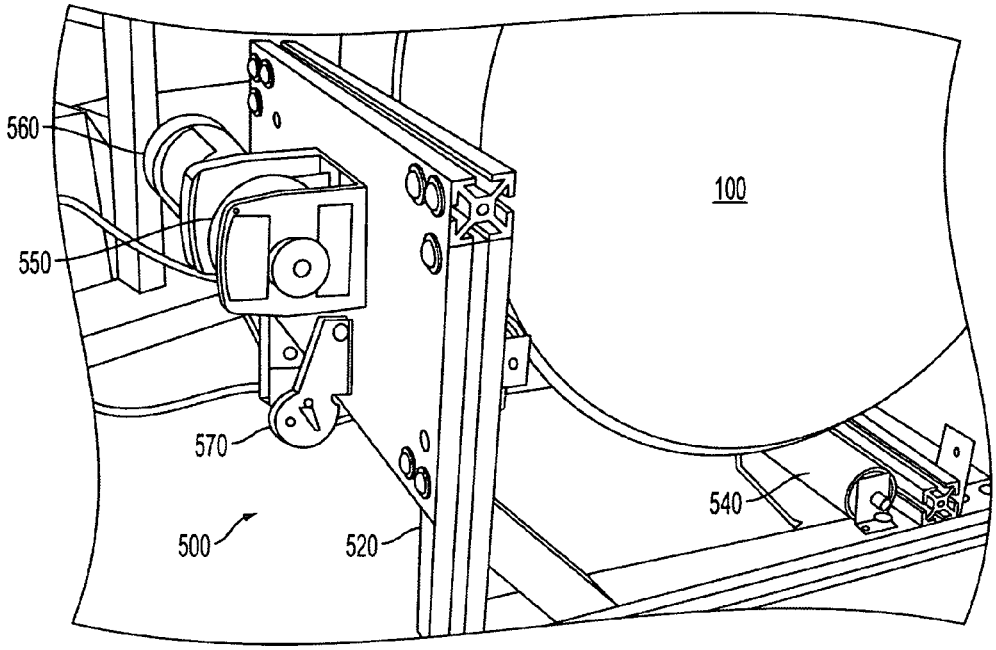
FIGS. 5A and 5B are perspective views of an exemplary embodiment of the disclosed device.
Figure 5B:
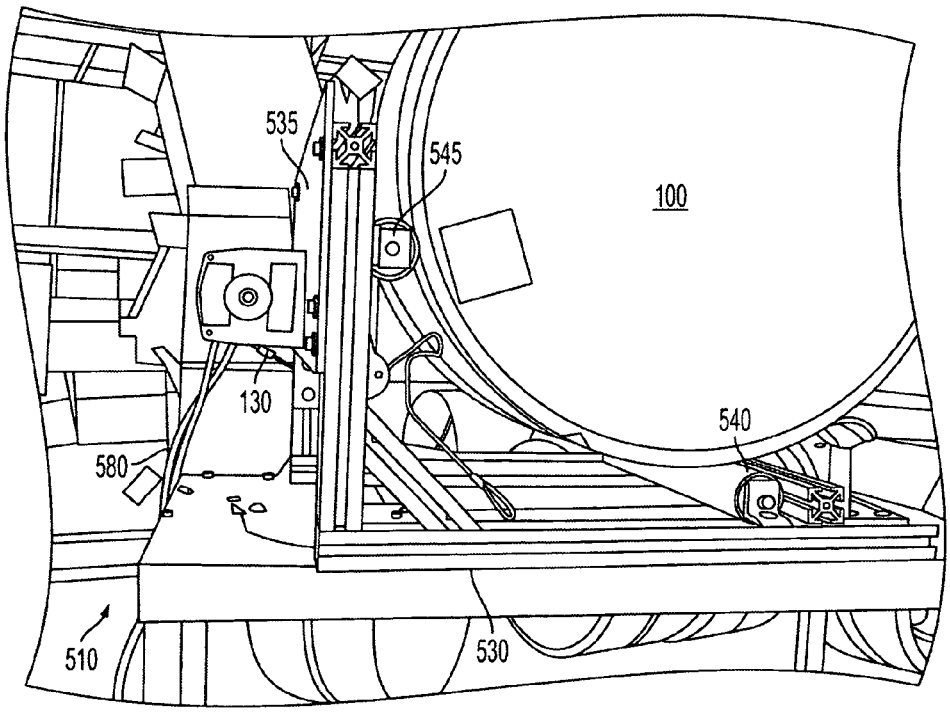

FIGS. 5A and 5B show perspective views 500 and 510 of an exemplary embodiment of a powered canister opener. This device includes an electric-powered winch mounted on a compact frame that supports the canister 100 and includes rollers to permit the canister 100 to rotate freely during the opening process, with the cylindrical axis parallel to the floor.

The frame includes vertical members 520 mounted to horizontal members 530 that rest on a platform or the floor. The members 520, 530 are separated by a width sufficient to straddle the canister 100 along its height. A mount plate 535 attaches across the vertical members 520. Bottom free-rollers 540 are mounted across the horizontal members 530. Side free-rollers 545 are mounted across the vertical members 520. These free-rollers 540, 545 support the canister 100 along its radial periphery.

The winch, attached to the plate 535, includes a rotatable drum 550 with its turning axis parallel to the canister 100, an electric motor 560 coaxial with the drum 550, and a pulley 570 to strip the epoxy and guide the wire 130 to the drum 550. The motor 560 receives alternating current electric power from cords 580 via a control switch. The motor 560 turns the drum 550 that receives and spools the wire 130 to open the canister 100. The drum 550 includes a radially-protruding button, similar to the button 440 on the roll-around opener 400.

The sequence of operations for using this device is as follows: The horizontal members 530 are disposed on the floor (or table). The motor 560 is connected via the cords 580 to an electrical power source. A filter canister 100 is rolled onto the opener frame to rest along the rollers 540, 545. The canister 100 is rotated as needed to align one of the loops 150 for latching to the drum 550. By activating the switch controller, the winch operates such that the pull-cord wire 130 wraps around the drum 550.

As the motor 560 turns, the wire 130 is drawn from the epoxy seal 140 onto the drum 550. During this interval, the canister 100 rotates freely on the frame rollers 540, 545. Upon drawing the wire completely from the interface between the top and bottom portions 110, 120, the canister 100 is rolled off of the frame for filter extraction. The wire 130 is removed from the drum 550 and discarded. The operations rolling through discarding operations can be repeated as necessary to complete opening all of the filter canisters as intended.

The power driver CBR filter canister opener presents the following advantages as compared to previous manual and powered systems: (a) reduced labor requirements for filter change-out events, (b) reduced worker fatigue, (c) reduced potential for injury, (d) equivalent opening cycle time, and (e) compact volume and portability.

Reduced labor: Conventional execution of change-out of a CBR filter system (typically replacement of 50-to-200 filters in canisters) requires a large work crew open filters in a timely fashion with minimal worker fatigue or injury. The disclosed device enables using smaller work parties.

Reduced fatigue: Opening CBR filter canisters can tire personnel greatly. The overall task conventionally involves multiple lifting, bending, and straining operations to open a single canister. The disclosed device performs most of the physical labor, thereby reducing worker fatigue.

Reduced potential for personnel injury and filter damage. Opening a filter canister presents several opportunities for injury, such as slipping, tripping, falling, dropping, muscle straining, etc. By obviating manual exertion, the disclosed device reduces these risks.

Equivalent opening cycle time: The conventional time to open a single canister 100 is approximately 45-seconds to one-minute. The disclosed device presents similar cycle times, thereby enabling the other advantages without degradation in performance.

Compact and portable design: Previously developed prototypes to open filter canisters have been unwieldably large and necessitated considerable volume to transport or lacking in structural stiffness. The disclosed device pro-vides structural support while maintaining the loading and operational ability to open the canister 100.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A device for opening a cylindrically bilateral filter canister, said canister being sealed with a pull-cord that ends in an eye-loop, said device being disposed on a platform and comprising:

a frame including first and second support members, said first support member engaging the platform and supporting said second support member;

first and second rollers disposed parallel to the platform to support the canister along its periphery, a winch having a drum and a motor, said drum engaging the eye-loop and said motor turning said drum to receive the pull-cord from the canister, said winch being disposed on said frame.

2. The device according to claim 1, wherein said first and second rollers mount respectively on said first and second support members.

3. The device according to claim 1, wherein said winch is disposed on said second support member of said frame.

4. The device according to claim 1, wherein said motor is coaxial to said drum.

5. The device according to claim 1, wherein said winch further includes a pulley catch to lead the pull-cord to said drum.

6. The device according to claim 1, wherein said motor is an electric motor.

* * * * *

UNITED STATES PATENT AND TRADEMARK OFFICE

CERTIFICATE OF CORRECTION

PATENT NO. : 8,066,262 B1
APPLICATION NO. : 12/456270
DATED : November 29, 2011
INVENTOR(S) : Walter Dzula, III et al.

It is certified that error appears in the above-identified patent and that said Letters Patent is hereby corrected as shown below:

Title page, item (75) Inventors:
on line 7 replace "Anthony Charlie Richardson" with --Anthony Charlie Nicoletti--.

Signed and Sealed this
Thirty-first Day of January, 2012

David J. Kappos

David J. Kappos
*Director of the United States Patent and Trademark Office*